US005157363A

United States Patent [19]

Puurunen et al.

[11] Patent Number: 5,157,363

[45] Date of Patent: Oct. 20, 1992

[54] HELICAL RESONATOR FILTER WITH ADJUSTABLE COUPLINGS

[75] Inventors: Pertti Puurunen; Kai Lehmus, both of Oulu, Finland

[73] Assignee: LK Products, Kempele, Finland

[21] Appl. No.: 650,875

[22] Filed: Feb. 5, 1991

[30] Foreign Application Priority Data

Feb. 7, 1990 [FI] Finland ..... 900612

[51] Int. Cl.[5] ..... H01P 1/20

[52] U.S. Cl. ..... 333/202; 333/212

[58] Field of Search ..... 333/202, 203, 219, 235, 333/230, 212, 180, 231-233

[56] References Cited

U.S. PATENT DOCUMENTS

| | | | |
|---|---|---|---|
| 2,922,122 | 1/1960 | Harkless | 333/113 |
| 3,624,515 | 11/1971 | Rezek | 455/150 |
| 3,715,690 | 2/1973 | Young et al. | 333/202 X |
| 3,728,731 | 4/1973 | Choi et al. | 333/202 X |
| 3,820,045 | 6/1974 | Igarashi | 333/185 |
| 3,836,881 | 9/1974 | Koizumi | 336/87 |
| 4,028,651 | 6/1977 | Leetmaa | 333/212 |
| 4,210,884 | 7/1980 | Tabuchi et al. | 333/212 X |
| 4,251,787 | 2/1981 | Young et al. | 333/209 |
| 4,490,699 | 12/1984 | Yanagida | 333/202 |
| 4,682,131 | 7/1987 | May | 333/202 |
| 4,701,728 | 10/1987 | Igarashi | 333/212 |

FOREIGN PATENT DOCUMENTS

| | | | |
|---|---|---|---|
| 0075498 | 3/1983 | France | 333/212 |
| 654126 | 8/1948 | United Kingdom . | |
| 1297224 | 4/1971 | United Kingdom . | |

OTHER PUBLICATIONS

Improved Design of a Helical Resonator Filter for 450-500 MHZ Band Land Mobile Communication by Banmail Rawat, 5 pages, 8105 IEEE Transactions on Vehicular Technology, VT—33 (1984) Feb., No. 1, N.Y. USA.

Japanese Abstracts, vol. 9, No. 143 (E-322) (1866) Jun. 18, 1985, Entitled Waveguide Form Polarized Filter by Fujitsu K.K.

Microwave Transmissions Circuits, by George L. Ragan, First Edition, Copyright 1948 by McGraw-Hill Book Co.

European Search Report dated Jun. 4, 1991, PDG/16032, 91300929.6—LK-Products OY.

*Primary Examiner*—Eugene R. LaRoche
*Assistant Examiner*—Seung Ham
*Attorney, Agent, or Firm*—Banner, Birch, McKie & Beckett

[57] ABSTRACT

A high-frequency filter employing helix resonators and a metallic or metallized cover. The cover contains at least two helix-shaped resonator coils separated from each other by a metallic or metallized partition provided with an aperture which there is a tuning strip, by reducing the size of which the size of the aperture can be enlarged and thereby the electrical coupling between the resonators adjusted.

10 Claims, 1 Drawing Sheet

HELICAL RESONATOR FILTER WITH ADJUSTABLE COUPLINGS

BACKGROUND OF THE INVENTION

1. Technical Field

The present invention relates to a high frequency filter employing helical resonators, and more specifically, to adjustment of the coupling opening or openings of filters employing helical resonators.

2. Discussion of the Relevant Art

The use of a helical resonator as a circuit element is well known in the art, and is widely used in filters of a high frequency range, in particular 100 to 1000 MHz. Such resonators comprise elements which are a helically wound coil and a metallic cover surrounding said coil at a distance. The low-impedance (grounded) end of the coil may be directly connected to the metal cover. In practice, this takes place in that a wire to be wound into a helical coil is at this end straight for some length and positioned so as to be approximately perpendicular to the end face of the resonator cover, whereby a first turn of the helical coil is at a length of the straight leg from the end face of the cover. The opposite, high-impedance end of the coil is in the proximity of the cover, being capacitively coupled thereto. The resonator can be connected electrically to the rest of the filter circuit either so that the low-impedance end is not connected to the cover; instead, a connecting lead insulated from the cover is connected thereto, or at a certain point of the helical coil is soldered a connecting lead which, being insulated from the cover, is taken outside the cover. The resonant frequency of the helical resonator is the function of the physical dimensions of the coil, the capacitive structure, and the distance between the high-impedance end of the coil and the cover. Therefore, for obtaining a resonator of a given frequency range, an accurate and exact construction is required for manufacturing.

From the Finnish patent No. 78198 is known a helix resonator in which the helical coil has been supported with an insulating plate, whereby in one part of the insulating plate is positioned an electrical circuit formed from micro strips, to which the resonator has been electrically connected. The procedure of how to produce a helix resonator which is accurate concerning its tapping point and reproducible is described in the Finnish patent application No. 884953. The construction disclosed therein is partly the same as in the resonator disclosed in the Finnish patent No. 78198, with the exception that the micro strip is positioned at a given point of the surface of the insulating plate, whereby, when a coil is inserted to the insulating plate, it is always coupled to the same point of the micro strip. The micro strip can be taken out from the resonator directly or it may be connected to the electric circuit of an insulating plate disclosed in the Finnish patent No. 78198, the plate acting as a support.

Such high frequency filters employing helix resonators are known in the art which comprise a metallic or metallized cover housing a number of helix-shaped resonator coils separated from each other by metallic or metallized partitions, wherein coupling apertures have been made for regulating the electrical coupling between the separate resonators. The coupling aperture is simply an aperture of a given size punched in the wall between the resonators. In different filter versions the aperture size is different for different resonant frequencies, that is, each version has a specific aperture size. The size of the aperture has to be highly precise, the tolerance for its width and height being +/− 0.01 mm in practice. Therefore, a specific punching tool has heretofore been provided for each aperture of a given size, that is, there is a punching tool for each aperture size. One of the drawbacks of this technique is that a great number of tools are needed, namely, as many tools as there are aperture sizes, and considering the high price of such tools, the technique has a cost-increasing effect. Another drawback is that the dimensioning differences of the apertures are sometimes very small indeed, whence follows the risk that covers of similar appearance, but with slightly different apertures become mixed up. One more cost-increasing drawback is the need of large intermediate stores in large-scale serial production.

SUMMARY OF THE INVENTION

The object of the invention is to provide a high frequency filter with which the above drawbacks can be avoided and with which it is easy to regulate the electrical coupling between the resonator circuits with high precision.

The characteristic features of the invention are apparent in the accompanying claims.

The invention thus relates to a high frequency resonator employing, in the first place, helix resonators, and comprising a metallic or metallized cover surrounding at least two helix-shaped resonator coils separated with a metallic or metallized partition, which is provided with an aperture, the aperture being provided with an adjustable strip, by reducing the size of which the size of the aperture can be enlarged and thereby the electrical coupling between the resonator circuits adjusted.

As taught by the invention, the partition and the strip are advantageously formed from an integral piece of sheet metal.

The invention is based on the insight that instead of producing a great number of covers with apertures of different sizes in their partitions, only one type of basic cover is produced in which in its manufacturing stage in the aperture of the partition is formed a strip parallel to the plane of the partition, and which can be shortened at the assembly station using a simple tool to fit the specific version. The shortening operation adjusts the coupling on the coarse level. Fine adjustment can be accomplished by twisting or bending the strip and thus by continuously changing the area of the aperture. Version-specific dimensioning of the aperture can be achieved in this manner with ease and at a low cost.

The invention is described below more in detail in the form of advantageous embodiments, and by referring to the accompanying drawing, wherein:

DETAILED DESCRIPTION

Figure 1:
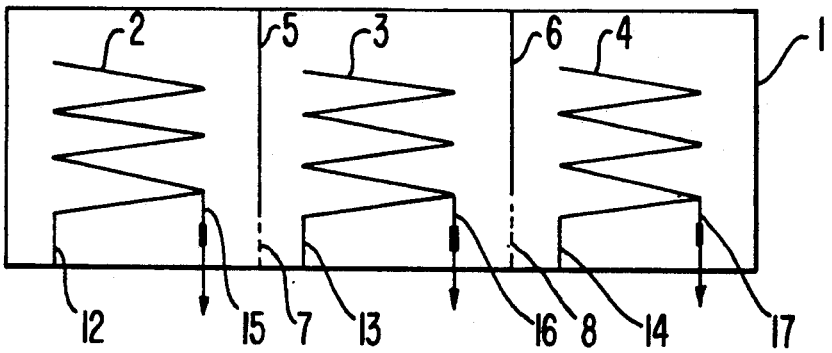
FIG. 1 presents a vertical section of a high frequency filter according to the invention.

In FIG. 1 the metallic or metallized cover of a high frequency filter is indicated by reference numeral 1. In the present example the cover 1 is divided by two partitions 5 and 6 in order to form three cavities. In each cavity is disposed a wire wound into a helix and constituting a coil 2, 3 and 4 of the helix resonator. Each coil has been connected by its so-called low-impedance end to the bottom of the cover 1 through a straight section of the coil, which constitutes the leg 12, 13, 14 of the resonator. Connection between the resonators, or with the environment, is by the aid of conductors 15, 16, 17 soldered to the coils 2, 3 and 4, which may be micro strip leads connected to the electrical circuit on the insulating plate (not shown) used to support the coils. This arrangement is known as tapping. At their upper ends, that is at the high-impedance end, the coils 2, 3, 4 are open and constitute a capacitive coupling to the end of the resonator cover. The coils 2, 3, 4 may be supported, as mentioned above, by way of an insulating plate installed therewithin, the plate being, in turn, supported by the cover 1, or the support may be arranged in another way known in the art. When the resonators are connected to the electrical circuit, the cover 1 is grounded at the same time. In the partitions 5 and 6, the design of which is better seen in FIG. 2, coupling apertures 7 and 8 have been provided.

Figure 2:
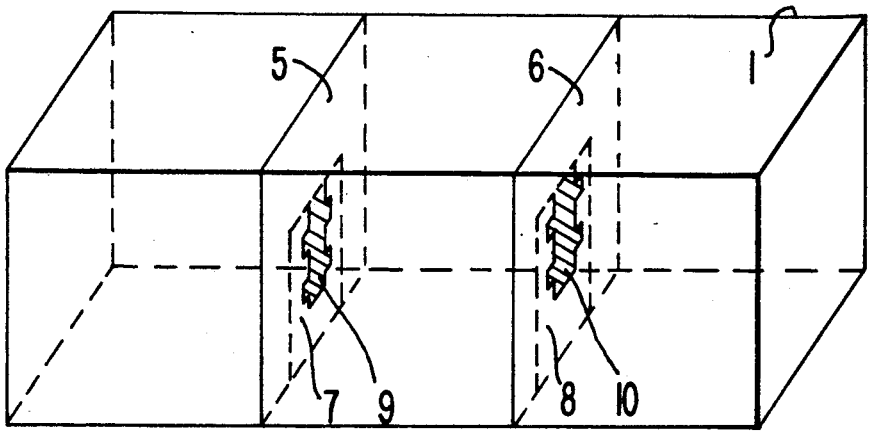
FIG. 2 presents a perspective view of the cover design of the high-frequency filter of FIG. 1.

FIG. 2 presents the high frequency filter of the invention from which the resonator coils have been omitted. The cover 1 has partitions 5 and 6 which divide cover 1 into three cavities as mentioned above. The partitions 5 and 6 are provided with coupling apertures 7 and 8 in which adjustable strips 9 and 10 have been formed, the more detailed design of which being shown in FIG. 3.

Figure 3:
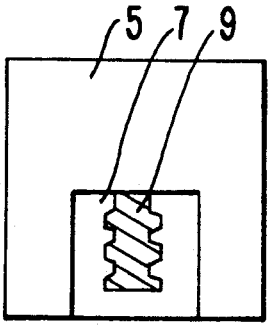
FIG. 3 presents a detail of the design of FIG. 2
Figure 4:
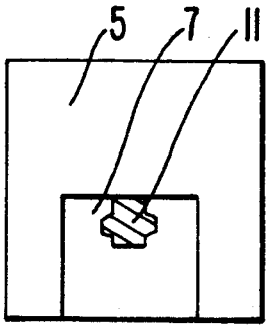
FIG. 4 presents the same design as FIG. 3, modified according to the invention.
Figure 5:
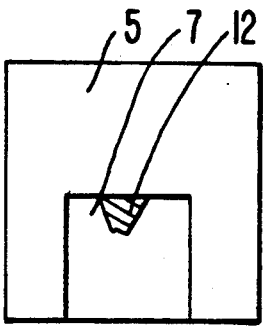
FIG. 5 shows the same design as FIG. 4, modified according to the invention.

FIG. 3 presents the design of the partition as that shown in FIG. 2. The partition 5 is a rectangular coupling aperture 7 in which an adjustable strip 9 has been formed, said strip being advantageously made of the same sheet blank as the partition and in the direction of the partition. In the present example the strip is a rectangular strip 9 provided with notches on its long sides. It is obvious, however, that the shape of the strip as well as the shape of the coupling aperture may within the scope of the invention deviate from that described above.

The adjustable strip 9 presented in FIG. 3 can be shortened at the assembly station using a simple tool to fit the specific version, whereby the shortened strip is indicated by reference numeral 11 and depicted out of the plane of the partition surface. The shortening of the strip regulates the electrical coupling between the resonator circuits on the coarse level. The electrical coupling may furthermore be fine-adjusted by twisting the shortened strip 11, whereby the bent strip is indicated by reference numeral 12. By the last-mentioned strip twisting operation the size of the coupling aperture can be changed continuously.

Only one embodiment of the invention is described above, and it is obvious that it may be varied within the scope of the claims. The resonator cover may therefore contain the number of resonator coils which are desired at any time, being separated with partitions, which may be disposed in one row, or in two or more parallel rows. In addition to the above resonator coils, which are provided with straight legs, also other types of coils known in themselves in the art can be used.

What is claimed is:

1. A high frequency filter including helical resonators, the filter comprising:

a cover having at least two cavities separated by a partition having an aperture; and a helical-shaped resonator coil disposed within each cavity;

wherein a size of the aperture serves to affect electrical coupling between the resonator coil disposed in each cavity, the partition having a tuning element extending from a first edge of the aperture parallel to the plane of the partition into the aperture, the partition and the tuning element being formed form a single piece, a length of the turning element being less than a length between the first edge of the aperture and a second edge of the aperture, the second edge being opposite the first edge of the aperture and a second edge of the aperture, the second edge being opposite the first edge, wherein a size of the turning element can be reduced to increase the size of the aperture, thereby adjusting the electrical coupling between the resonator coils.

2. The high-frequency filter according to claim 1, wherein the size of the aperture is increased by shortening the length of the tuning element, thereby changing the electrical coupling between the resonator coils.

3. The high-frequency filter according to claim 1, wherein the electrical coupling between the resonator coils can be adjusted by bending the tuning element out of parallel with the plane of the partition.

4. A multistage helical resonator filter cover comprising:

a shell member including a plurality of side walls and opposing end walls thereby defining a main cavity; and at least one partition formed within the main cavity, thereby forming a plurality of sub-cavities for holding resonant circuits of a multistage helical resonator filter, wherein at least one partition includes an aperture serving to affect electrical coupling between the subcavities, the aperture having a tuning element extending from a first edge of the aperture parallel to the plane of the partition into the aperture, the at least one partition and the tuning element being formed from a single piece, a length of the turning element being less than a length between the first edge of the aperture and a second edge of the aperture, the second edge being opposite the first edge, wherein a size of the turning element can be reduced to increase the size of the aperture and thereby changing the electrical coupling between the subcavities.

5. The multistage helical resonator filter cover according to claim 4, wherein the at least one partition and the turning element are coplanar.

6. The multistage helical resonator filter cover according to claim 4, wherein the size of the aperture is increased by shortening the length of tuning element, thereby changing the electrical coupling between the subcavities.

7. The multistage helical resonator filter cover according to claim 4, wherein the electrical coupling between the subcavities can be adjusted by bending the turning element out of parallel with the plane of the at least one partition.

8. The multistage helical resonator filter cover according to claim 5, wherein the electrical coupling between the subcavities can be adjusted by bending the tuning element into a plane which is not coplanar with the at least one partition.

9. A multistage helical resonator filter cover comprising:

a shell member including a plurality of side walls and opposing end walls thereby defining a main cavity; and at least one partition formed within the main cavity, thereby forming a plurality of sub-cavities for holding resonant circuits of a multistage helical resonator filter, wherein at least one partition includes an aperture serving to affect electrical coupling between the subcavities, the at least one partition having a turning element extending from a first edge of the aperture into the aperture parallel to the at least one partition and having a length being less than a length between the first edge of the aperture and a second edge of the aperture, the second edge being opposite the first edge, wherein a size of the tuning element can be reduced to increase the size of the aperture and thereby changing the electrical coupling between subcavities of the cover, and wherein the electrical coupling between the subcavities can be adjusted by bending the turning element out of parallel with the plane of the at least one partition.

10. A multistage helical resonator filter cover comprising:

a shell member including a plurality of side walls and opposing end walls thereby defining a main cavity; and at least one partition formed within the main cavity, thereby forming a plurality of sub-cavities for holding resonant circuits of a multistage helical resonator filter, wherein at least one partition includes an aperture serving to affect electrical coupling between the subcavities, the at least one partition having a tuning element extending from a first edge of the aperture into the aperture coplanar with the at least one partition and having a length being less than a length between the first edge of the aperture and a second edge of the aperture, the second edge being opposite the first edge, wherein a size of the turning element can be reduced to increase the size of the aperture and thereby changing the electrical coupling between the subcavities of the cover, and wherein the electrical coupling between the subcavities can be adjusted by bending the tuning element into a plane which is not coplanar with the at least one partition.

* * * * *